United States Patent [19]

Conti

[11] Patent Number: 4,993,571

[45] Date of Patent: Feb. 19, 1991

[54] TAMPER-EVIDENT CAP

[75] Inventor: Vincent N. Conti, Hempstead, N.Y.

[73] Assignee: American Safety Closure Corp., Farmingdale, N.Y.

[21] Appl. No.: 407,398

[22] Filed: Sep. 14, 1989

[51] Int. Cl.[5] ..... B65D 41/34

[52] U.S. Cl. ..... 215/252; 215/256

[58] Field of Search ..... 215/252, 250, 256, 258

[56] References Cited

U.S. PATENT DOCUMENTS

| | | | |
|---|---|---|---|
| 2,043,226 | 6/1936 | Beider et al. | 215/252 |
| 3,329,295 | 7/1967 | Fields | 215/252 |
| 3,455,478 | 7/1969 | Fields et al. | 215/252 |
| 3,463,341 | 8/1969 | Fields | 215/252 |
| 4,345,692 | 8/1982 | Obrist et al. | 215/252 |
| 4,352,436 | 10/1982 | Chartier et al. | 215/252 |
| 4,452,363 | 6/1984 | Davis | 215/258 |
| 4,461,390 | 7/1984 | Csasar | 215/252 |
| 4,555,039 | 11/1985 | Conti | 215/252 |
| 4,664,278 | 5/1987 | Barriac | 215/252 |
| 4,667,836 | 5/1987 | McLaren | 215/258 |
| 4,715,506 | 12/1987 | McLaren | 215/252 |
| 4,744,480 | 5/1988 | Luch et al. | 215/258 X |
| 4,878,589 | 11/1989 | Webster et al. | 215/252 |

*Primary Examiner*—Stephen Marcus

*Attorney, Agent, or Firm*—Nolte, Nolte and Hunter

[57] ABSTRACT

An improved plastic tamper-evident cap is molded on an internal mold member. The cap is adapted for use with a container having a threaded neck portion at a radially inwardly extending shoulder disposed below the threaded neck portion and facing axially away therefrom. The cap has a top wall, a depending skirt with an internal threading for engagement with the threaded neck portion of the container and a tamper-evident ring connected to the lower end of the skirt by frangible means. The tamper-evident ring has radially inwardly extending locking means adapted to slide over the shoulder. The improvement comprises a trapazoidal frangible member having a narrow top and a wide base. The top adjoins the skirt of the cap at sharp corners. The frangible member has curved adjoining portions between the frangible member at its base and the tamper-evident ring.

6 Claims, 2 Drawing Sheets

FIG. 1
PRIOR ART
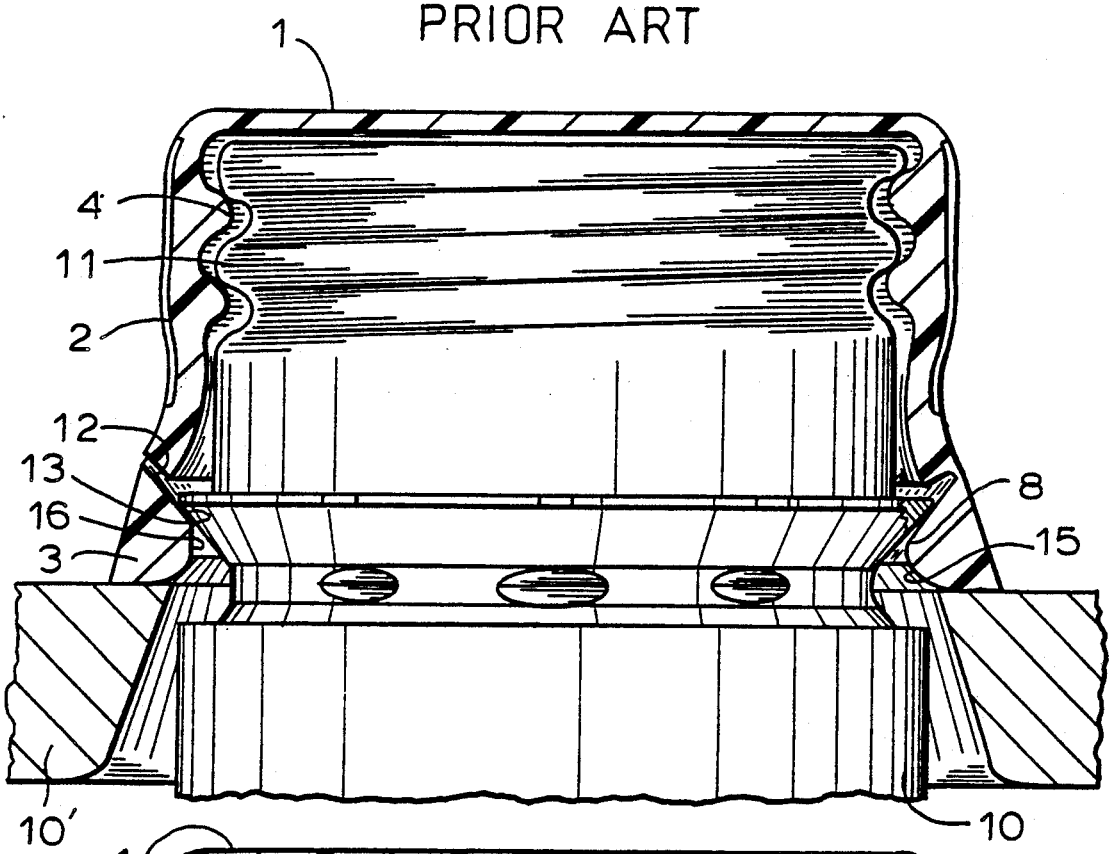
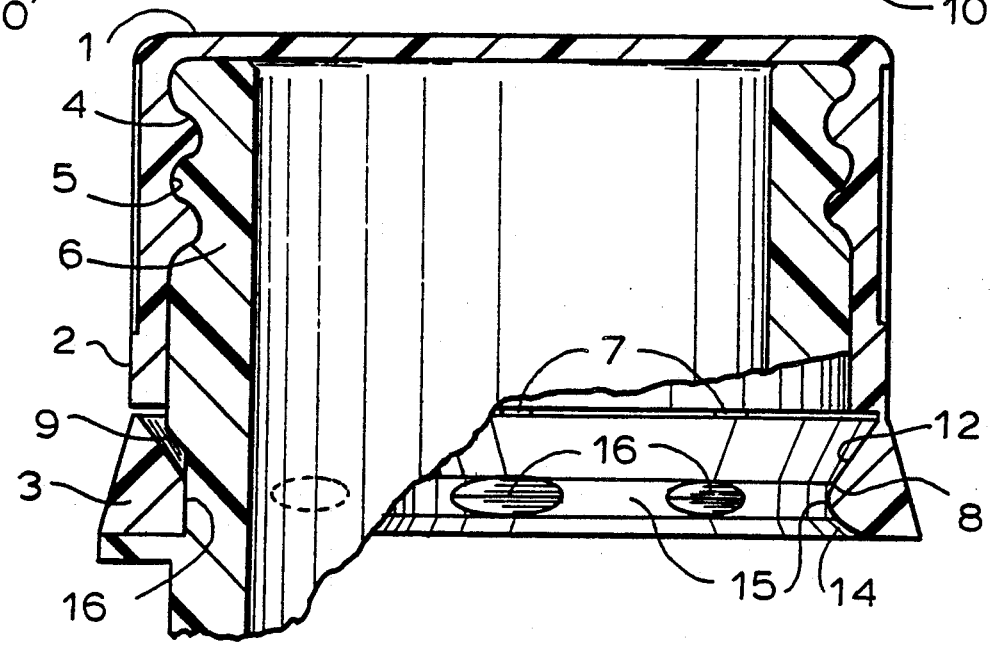
FIG. 2 PRIOR ART

TAMPER-EVIDENT CAP

BACKGROUND OF THE INVENTION

The present invention relates to an improved cap for use with containers whereby removal of the cap leaves behind a telltale ring member.

FIELD OF THE INVENTION

There are presently available many tamper-evident closure or cap constructions of this type. Generally, they are constructed with a threaded skirt portion extending downwardly from the top wall of the cap and a tamper-evident ring member attached to the lower end of the skirt. The ring is attached by frangible members which break upon unthreading of the cap from the container due to engagement of the ring member below a protruding ledge or shoulder on the container.

With metal closures, the formation of the tamper-evident ring is typically effected after the closure has been placed onto the container. More particularly, the tamper-evident ring is secured under a cooperating shoulder on the container neck by a deforming operation. With the advent of molded plastic caps, the tamper-evident ring portion of the cap is performed as part of the initial molding of the cap. This presents some problems with respect to structuring the tamper-evident ring and frangible members so that the cap can be threaded onto the container without breaking the frangible members. If breakage occurs, the ring is obviously of no value for use as an indicator of tampering with or removal of the closure.

The molding of plastic caps with tamper-evident rings also presents some problems. The molding operation requires an internal ie member for shaping the internal surface of the cap. This die member has external threads just like the bottle with which the cap is to be used. This thread structure and other portions of the die required for forming the tamper-evident ring can interfere with removal of the cap by obstructing the ring and causing it to break away just as if the cap were being unthreaded from the container.

Attempts have been made to design plastic caps to overcome the problems associated with molding and applying the cap to the container. My prior patent, U.S. Pat. No. 4,322,012, discloses a molded plastic tamper-evident cap in which the tamper-evident ring is attached to the skirt by frangible members and constructed internally with locking members having the appropriate camming surface to permit threading of the cap to the container without breaking of the frangible members. Molding of this type of cap construction, however, typically requires a collapsible inner die member.

U.S. Pat. No. 4,147,268 also discloses a molded plastic tamper-evident cap. In this cap the tamper-evident ring is constructed with internally protruding locking members which extend at an angle so as to permit the cap to be removed from the internal die meber by unthreading. This same structure permits the cap to be threaded onto the container. In addition, the locking members are provided with camming surfaces to permit sliding over the locking shoulder of the container as the cap is fully threaded onto the container.

In my previous patent, U.S. Pat. No. 4,555,039, the cap included a tamper-evident ring which was structured and connected to the skirt portion of the cap in such a manner as to readily permit its removal from the internal molding die and subsequent attachment to the container. More particularly, the tamper-evident ring was constructed with an inwardly protruding locking means for engagement under a cooperating shoulder on the neck of the container to which it was applied. The frangible means which connected the tamper-evident ring to the lower end of the skirt portion of the cap was axially aligned with both the skirt and the tamper-evident ring.

With the above construction, the molded cap could be removed from the internal die structure used in the cap molding operation by axially pushing on the bottom of the tamper-evident ring. The axial alignment of the frangible members with the skirt and ring together with their thickness provided enough axial rigidity to prevent the tamper-evident ring from unduly flexing relative to the skirt portion of the cap during this removal operation. The entire wall structure of the cap simply expanded more or less as an integral unit. Thus, breaking of the frangible members was avoided. This same feature was also useful during attaching the cap to the container. As the cap was threaded down onto the neck of the container, the bottom of the tamper-evident ring engaged against the threads and created an axial compression of the ring toward the overlying skirt. This held the ring, frangible members and skirt together in compression as an integral unit and permitted them to expand without such severe flexing of the ring relative to the skirt which would cause breaking of the frangible members. The bottom surface of the protruding locking means on the tamper-evident ring was also structured to readily permit this expansion of the ring over the threaded portion of the neck of the container.

SUMMARY OF THE INVENTION

The present invention is an improvement on my '039 patent. In the present invention, the tamper-evident ring has been thinned with respect to the cap, particularly at the top of the ring. The ring then tapers outward to a wider base and includes a protrusion interspersed by flats described in the '039 patent. This has the dual effects of saving material and providing a more resilient ring which is more easily seated over the cooperating locking shoulder on the neck of the container. The frangible members having also been redesigned to increase their likelihood of breaking off flush on the undersurface of the cap, thus eliminating any possible uncomfortable porcupine-like members from the underside of the cap.

BRIEF DESCRIPTION OF THE DRAWINGS

FIG. 1 is an enlarged cross-sectional view of the cap of the '039 patent showing part of the internal mold structure on which it is molded and with the cap partially removed therefrom; and FIG. 2 is an enlarged cross-sectional view, partly broken away, showing the cap of the '039 patent as attached to a container.

DESCRIPTION OF THE PREFERRED EMBODIMENT

Figure 3:
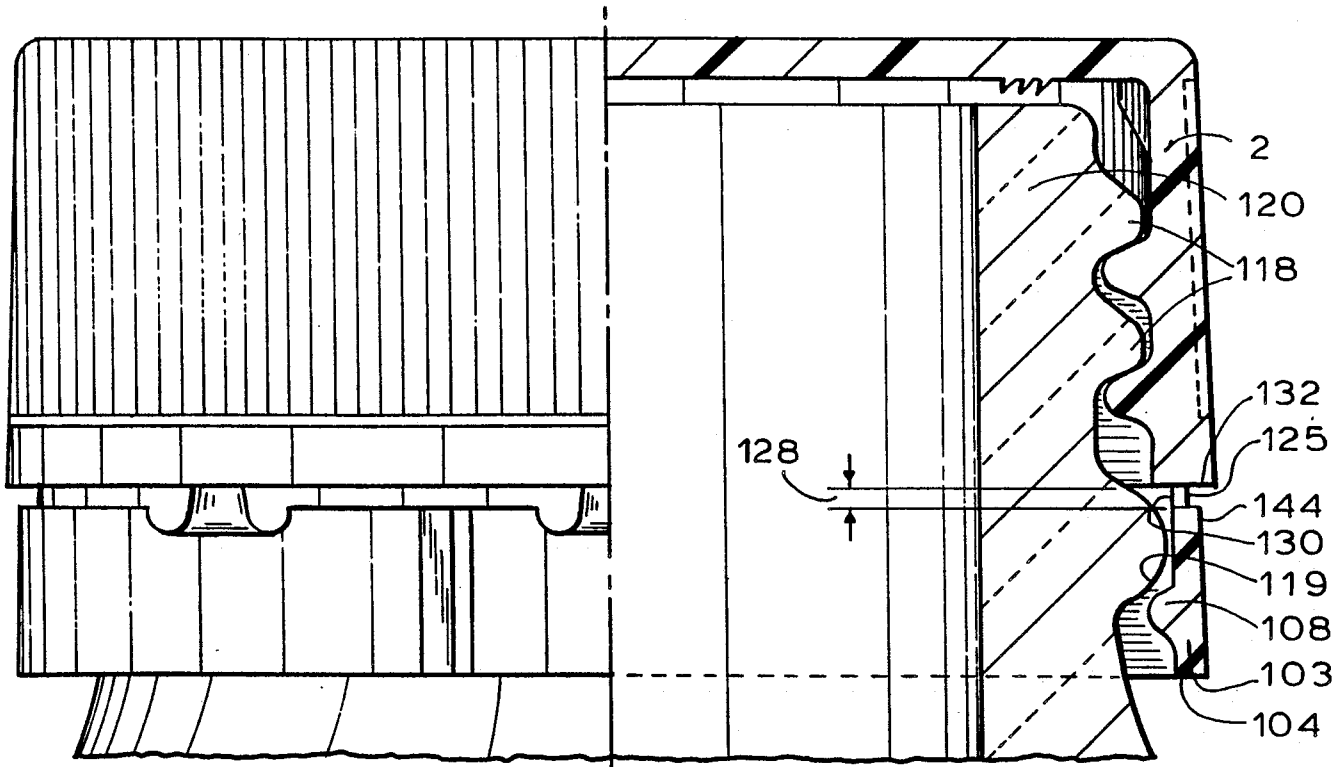
FIG. 3 is an enlarged cross-sectional view of a portion of the cap of the present invention partially showing the container on which it resides and the improved tamper-evident ring.

As in FIGS. 1 and 2, the cap of the present invention generally includes a top wall 1, a depending side wall or skirt 2 and the improved tamper-evident ring 3 attached to the bottom end of the skirt. The internal wall surface of the skirt includes a threaded portion 4 adapted to mate with complementary threads 5 on the neck 6 of a container such as shown in FIG. 2.

The tamper-evident ring 3 is connected to the skirt portion of the cap by separate frangible members 7 and includes a radially inwardly extending locking means in the form of an inwardly directed protrusion 8 extending completely around the inner periphery of the ring. The locking means is adapted to slide over a shoulder 9 on the outside surface of the container neck as the cap is threaded onto the container. With the cap fully threaded onto the container, the locking means is positioned under the shoulder 9 so that upon unthreading of the cap, upward movement of the tamper-evident ring will be blocked thereby. The frangible members 7 connecting the ring to the skirt are constructed so that they will break away as the ring engages the shoulder 9. This puts the members 7 in tension and at the same time causes the ring to expand outwardly, in turn, causing flexing of the members. The combined pulling and flexing of frangible members 7 causes their breaking.

In accordance with the teachings of the present invention, frangible members 7 are axially aligned with both skirt 2 and ring 3 portions of the cap adjacent the outside surface of skirt 2. They also are constructed with a sufficient cross-sectional dimension so as to provide axial rigidity between skirt 2 and ring 3 upon subjecting ring 3 to an axial compressive force directed toward skirt 2. This construction facilitates removal of the molded cap from the internal die member 10 on which it is formed. Removal is effected by pushing the cap off the internal die member by a stripper ring 10'. The pushing force is exerted against the bottom of the tamper-evident ring as indicated in FIG. 1. Due to the axial alignment of frangible members 7 with both ring 3 and skirt 2 and also due to the cross-section thickness of the frangible members, the force exerted on the bottom of ring 3 puts members 7 in compression. The pushing force is directed in a generally straight line through the ring 3, frangible members 7 and skirt 2 with the result that there is little bending moment created.

The cap generally expands radially outwardly as it is removed from the internal die member 10 as shown in FIG. 1. There it is seen that the internal thread 4 of the cap, as it engages against the external thread 11 on the die member 10, effects a camming of the skirt portion 2 of the cap radially outwardly of die member 10. The skirt actually expands as it is cammed over the die threads. At the same time the upper surface 12 of the locking protrusion 8 on the tamper-evident ring engages against the complementary shaped wall surface 13 of internal die member 10. This engagement effects a camming of ring 3 in a radially outwardly direction to cause it to expand at the same time skirt 2 is being cammed and expanded radially outwardly.

Due to the location of the frangible members and the rigidity provided by their cross-sectional thickness, the skirt and ring expand more or less as an integral unit without flexing of the ring relative to the skirt to an extent which would cause breaking of the frangible members. Removal of the molded cap from the internal die member can therefore be accomplished with a simple pushing operation. Complicated collapsible die structure is not required.

In the preferred embodiment of the present invention the inwardly directed protrusion 8 of the locking portion of tamper-evident ring 3 has an axial cross-section which is generally conical in shape. That is, this cross section of protrusion 8 has a shape generally similar to the shape of an axial cross section of a solid cone. The upper surface 12 of this protrusion is a straight surface; and as shown in FIG. 2, this surface is disposed at an angle about equal to the angle at which the shoulder 9 of the container extends. The bottom surface of the protrusion has an axially downwardly facing convex surface 14. These surfaces facilitate connection of the cap to the container and retention of the ring on the container upon removal of the cap. More particularly, the flat surface 12 engages against the complementary shaped surface of the shoulder 9 whereby axial unthreading of the cap produces a pulling effect on ring 3 and frangible members 7 to put them in tension. The tensioning or pulling on the frangible members together with their simultaneous flexing as the ring is cammed outwardly over the shoulder 9 of the bottle causes the frangible members to break.

The convex shape of bottom surface 14 of protrusion 8 of tamper-evident ring 3 assists in camming the ring over threads 5 of the container neck as the cap is threaded onto the container. Again, engagement of the bottom of the ring against the threads produces some compressive force through the ring, frangible members and skirt, coupling these members together as an integral unit to thereby prevent undue flexing of the ring relative to the skirt. And without any simultaneous pulling of the frangible members as occurs upon removing the cap from the container, they do not break.

As shown in FIGS. 1 and 2, the radially inward-most surface of the protrusion 8 of the tamper-evident ring is provided with multiple circumferentially spaced areas 15 disposed radially outwardly of the remainder of this surface. Although these areas 15 are located radially outwardly of the innermost extent of the protrusion, they will, nevertheless, be located under the shoulder 9 of the container when the cap is fully threaded onto the container. This is shown in FIG. 2. Accordingly, engagement of the upper surface 12 of the protrusion with the shoulder 9 occurs at all points around the tamper-evident ring.

Circumferentially spaced areas 15 are curved to define radially inwardly facing curved portions and they are evenly spaced from each other. Together they extend over one-half of the inner periphery of the protrusion 8. There are eight such areas spaced about the internal periphery and each area covers a circumferential distance of about 22½°. The remainder of the inner surface of the protrusion 8 is formed as flats 16. These flats define chordal portions, spaced between the curved portions of the protrusion, and are aligned with the frangible members 7.

In the present embodiment, improved over the '039 patent version and shown in FIG. 3, tamper-evident ring 103 is selectively shaped to taper from a wide portion at its base 104 to a narrow portion at its top 130 and to be smaller throughout its cross-sectional width than the cross-sectional width of the depending sidewall or skirt 2.

Tamper-evident ring 103 still comprises a plurality of protrusions 108 which are discontinuous to facilitate sliding ring 103 over threads 118 and stripper lip 119 of bottle 120.

Figure 4:
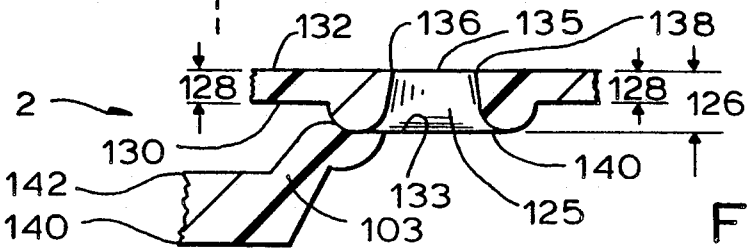
FIG. 4 is a detail in elevation of a portion of the improved tamper-evident ring at a frangible member which attaches said ring to the underside of the cap.
Figure 3:
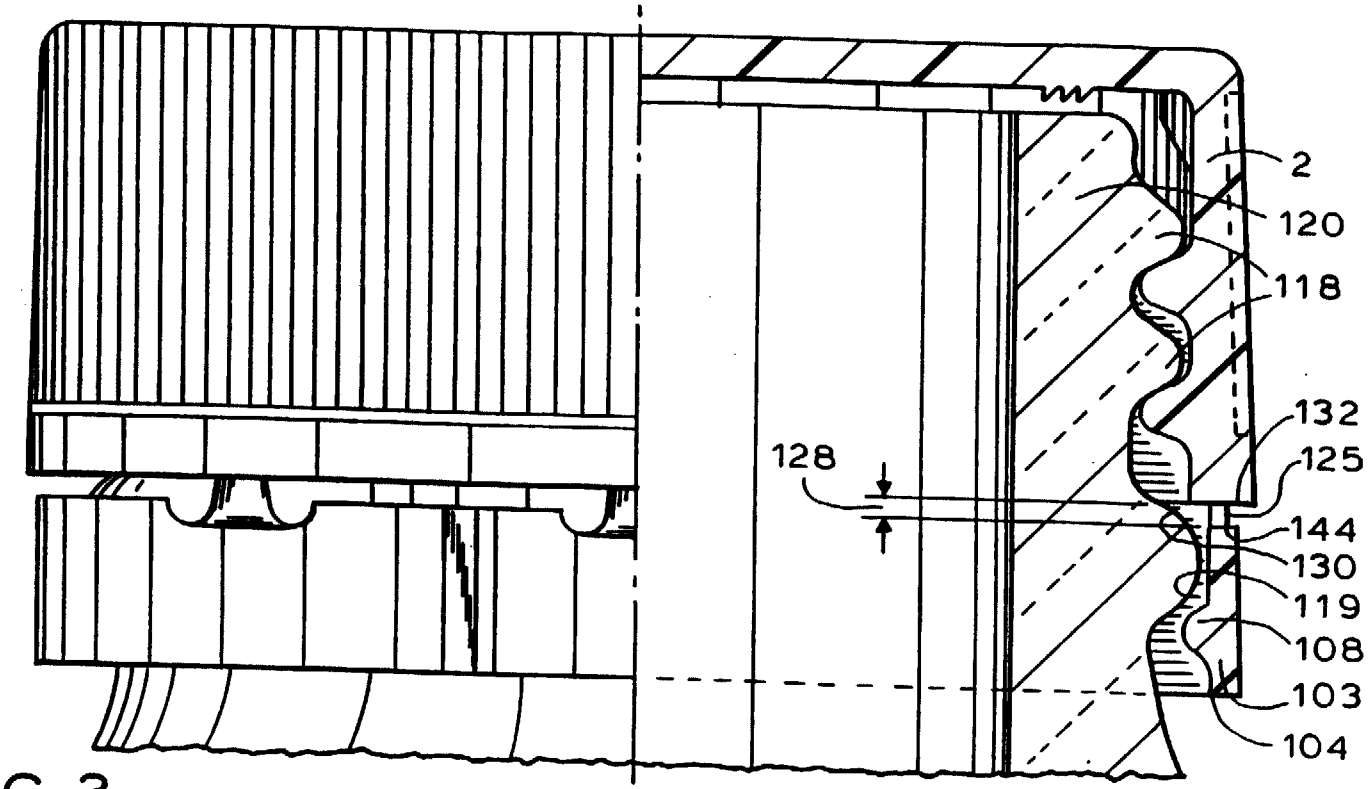
Figure 4:
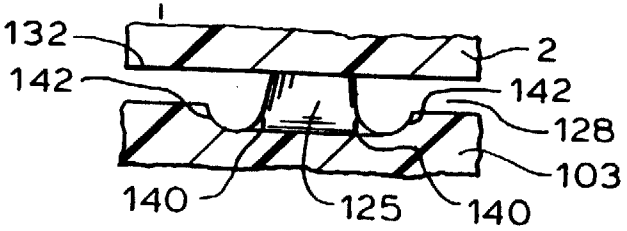

As is seen in FIG. 4, frangible member 125 has a height 126 greater than distance 128 between top surface 130 of ring 103 and circumferentially continuous bottom surface 132 of cap sidewall 2.

Additionally, frangible member 125 is trapezoidal tapering from a narrow length at its top 135, where it joins bottom 132 of sidewall 2, to a longer length at its trapezoidal base 133. This increases the likelihood that frangible member 125 will break at its top 135 rather than at its base 133. To further increase this likelihood, sharp corners 136, 138 are provided at this upper juncture to increase the strain at this point and further increase the likelihood of breakage at top 135 of frangible member 125. To further reduce the likelihood of breakage at the base 133 of frangible member 125, frangible member 125 tapers through a radiused curve 140 into the body of tamper-evident ring 103. This curve continues through curve 142 where it meets top surface 130 of ring 103. As can be seen in FIG. 3, the frangible member also curves outwardly in a radial direction as is shown by dotted line 144. Its radial dimension is smaller than the radial dimension of the skirt and of the tamper-evident ring.

The construction of frangible member 125 also reduces the possibility that it will be undesirably broken during the application of the cap to the bottle. When protrusions 108 are jammed down onto to the sloping upper surface of stripper lip 119, the resilient frangible member 125 is capable of bending to some degree and allowing ring 103 to seat under compression against bottom surface 132 of sidewall 2. Since the height of frangible member 125 is approximately twice the distance 128 that ring 103 can travel relative to sidewall 2 before surfaces 132 and 130 contact each other and limit further travel, the likelihood of frangible member 125 breaking under this compressive operation is significantly reduced.

I claim:

1. An improved plastic tamper-evident cap molded on an internal mold member and adapted for use with a container having a threaded neck portion and a radially outwardly extending shoulder disposed below the threaded neck portion and facing axially away therefrom, the cap having a top wall, a depending skirt with internal threading for engagement with the threaded neck portion of the container and a continuous annular lower surface and a tamper-evident ring having an upper annular surface spaced a predetermined distance from and juxtaposed to said continuous annular lower surface of said skirt and connected to the lower end of the skirt by frangible means and having radially inwardly extending locking means adapted to like over the shoulder of the container; the improvement comprising:

said frangible means comprising a plurality of trapezoidal frangible members each having circumferentially spaced side edges defining a narrow top and wide base, said side edges at said top adjoining the skirt of the cap at sharp corners;

the side edges at said wide base of each of said frangible members adjoining said tamper-evident ring at curved corners;

the upper surface of said ring comprising a substantially continuous annulus interrupted by recesses, said side edges at said base of each of said frangible members being disposed within one of said recesses;

said frangible member having a height and being flexible therealong;

the height of the frangible member exceeding a distance between an upper surface of said tamper-evident ring and said lower continuous annular surface of the depending skirt, so that upon partial flexure of said frangible member when said locking means is forced over the container shoulder, the upper surface of said tamper evident ring sits under compression against said lower continuous annular surface of said skirt.

2. An improved plastic tamper-evident cap molded on an internal mold member and adapted for use with a container having a threaded neck portion and a radially outwardly extending shoulder dispose below the threaded neck portion and facing axially away therefrom, the cap having a top wall, a depending skirt with internal threading for engagement with the threaded neck portion of the container and a tamper-evident ring connected to the lower end of the skirt by frangible means and having a substantially continuous annular upper surface free of upwardly extending protrusions and having radially inwardly extending locking means adapted to slide over the shoulder when said cap is treaded onto the container and to remain beneath the shoulder when said cap is threaded off the container placing said frangible means in tension;

said frangible means comprising a trapezoidal frangible member having a a narrow top and wide base, said top adjoining the skirt of the cap at sharp corners;

curved adjoining portions between said frangible member at its base, and the tamper-evident ring;

said frangible member having a height;

the height of the frangible member exceeding a distance between an upper surface of the tamper-evident ring and lower surface of the depending skirt; and the wide base of the frangible member being recessed below the upper surface of the tamper-evident ring whereby when said cap is threaded off the container, said frangible member is broken away from said skirt at said sharp corners under tension.

3. A tamper-evident cap according to claim 2 in which the height of the frangible member is approximately twice the distance between the bottom of the skirt and the top of the tamper-evident ring.

4. A tamper-evident cap according to claim 3 in which the tamper-evident ring is smaller in cross-sectional radial dimension than the corresponding dimension of the skirt, and in which the tamper-evident ring tapers from a narrow top to a wider base, said base still being of a smaller radial dimension than that of the skirt.

5. A cap according to claim 4 in which the frangible member is smaller in its radial dimension than the radial dimension of both the skirt and of the tamper-evident ring.

6. An improved plastic tamper-evident cap molded on an internal mold member and adapted for use with a container having a threaded neck portion and a radially outwardly extending shoulder disposed below the threaded neck portion and facing axially away therefrom, the cap having a top wall, a depending skirt with internal threading for engagement with the threaded neck portion of the container and a tamper-evident ring connected to the lower end of the skirt by frangible means and having a substantially continuous annular upper surface free of upwardly extending protrusion and radially inwardly extending locking means adapted to slide over the shoulder upon threading the cap onto the container and to engage against the shoulder upon unthreading of the cap to cause the frangible means to break and the ring to separate from the skirt of he cap under tension;

the frangible means aligned axially with the skirt and ring;

the locking means consisting of a radially inwardly directed protrusion extending around the internal periphery of the ring; and the protrusion, in axial cross-section, having a generally conical shape with the radially inwardly facing surface having multiple circumferentially spaced areas disposed radially outwardly of remainder of said surface, said areas each defining a radially inwardly facing curved portion and the remainder of said surface defining chordal portion;

the improvement comprising:

said frangible means comprising a trapezoidal frangible member having a narrow top and wide base, said top adjoining the skirt of the cap at sharp corners, said base being recessed below the upper surface of the tamper-evident ring;

radiused adjoining portions between said frangible member at its base and the tamper-evident ring;

a height of the frangible member exceeding a distance between an upper surface of the tamper-evident ring and lower surface of the depending skirt;

the frangible member having a height which is approximately twice the distance between the bottom of the skirt and the top of the tamper-evident ring;

said tamper-evident ring being smaller in cross-sectional radial dimension than the corresponding dimension of the skirt, said tamper-evident ring tapering from a narrow ring top to s wider ring base, said ring base still being of a smaller radial dimension than that of the skirt;

said base of said frangible member being recessed below the upper surface of the tamper-evident ring; and said frangible member being smaller in its radial dimension than the radial dimension of both said skirt and of said tamper-evident ring.

* * * * *

UNITED STATES PATENT AND TRADEMARK OFFICE
CERTIFICATE OF CORRECTION

PATENT NO. : 4,993,571

DATED : Feb. 19, 1991

INVENTOR(S) : Vincent N. Conti

It is certified that error appears in the above-identified patent and that said Letters Patent is hereby corrected as shown below:

The title page showing the illustrative figure should be deleted to be replaced with the attached title page.

The sheet of drawings consisting of FIGS. 3 and 4, should be deleted to be replaced with the sheet of drawings, consisting of FIGS. 3 and 4, as shown on the attached sheet.

Signed and Sealed this

Third Day of March, 1992

*Attest:*

HARRY F. MANBECK, JR.

*Attesting Officer*

*Commissioner of Patents and Trademarks*

United States Patent [19]

Conti

[11] Patent Number: 4,993,571

[45] Date of Patent: Feb. 19, 1991

[54] TAMPER-EVIDENT CAP

[75] Inventor: Vincent N. Conti, Hempstead, N.Y.

[73] Assignee: American Safety Closure Corp., Farmingdale, N.Y.

[21] Appl. No.: 407,398

[22] Filed: Sep. 14, 1989

[51] Int. Cl.[5] ..... B65D 41/34

[52] U.S. Cl. ..... 215/252; 215/256

[58] Field of Search ..... 215/252, 250, 256, 258

[56] References Cited

U.S. PATENT DOCUMENTS

| | | | |
|---|---|---|---|
| 2,043,226 | 6/1936 | Beider et al. | 215/252 |
| 3,329,295 | 7/1967 | Fields | 215/252 |
| 3,455,478 | 7/1969 | Fields et al. | 215/252 |
| 3,463,341 | 8/1969 | Fields | 215/252 |
| 4,345,692 | 8/1982 | Obrist et al. | 215/252 |
| 4,352,436 | 10/1982 | Chartier et al. | 215/252 |
| 4,452,363 | 6/1984 | Davis | 215/258 |
| 4,461,390 | 7/1984 | Csasar | 215/252 |
| 4,555,039 | 11/1985 | Conti | 215/252 |
| 4,664,278 | 5/1987 | Barriac | 215/252 |
| 4,667,836 | 5/1987 | McLaren | 215/258 |
| 4,715,506 | 12/1987 | McLaren | 215/252 |
| 4,744,480 | 5/1988 | Luch et al. | 215/258 X |
| 4,878,589 | 11/1989 | Webster et al. | 215/252 |

*Primary Examiner*—Stephen Marcus

*Attorney, Agent, or Firm*—Nolte, Nolte and Hunter

[57] ABSTRACT

An improved plastic tamper-evident cap is molded on an internal mold member. The cap is adapted for use with a container having a threaded neck portion at a radially inwardly extending shoulder disposed below the threaded neck portion and facing axially away therefrom. The cap has a top wall, a depending skirt with an internal threading for engagement with the threaded neck portion of the container and a tamper-evident ring connected to the lower end of the skirt by frangible means. The tamper-evident ring has radially inwardly extending locking means adapted to slide over the shoulder. The improvement comprises a trapazoidal frangible member having a narrow top and a wide base. The top adjoins the skirt of the cap at sharp corners. The frangible member has curved adjoining portions between the frangible member at its base and the tamper-evident ring.

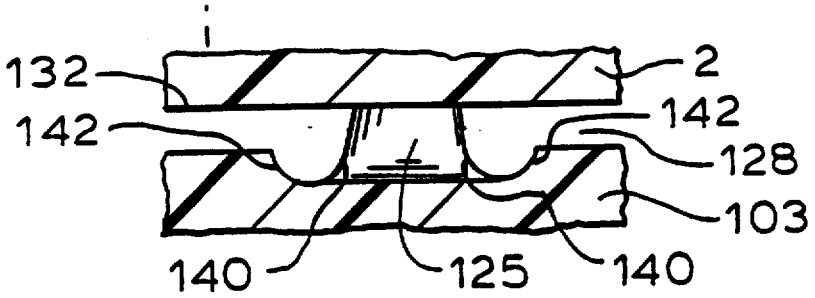

6 Claims, 2 Drawing Sheets